US009198524B2

(12) United States Patent
Horst et al.

(10) Patent No.: US 9,198,524 B2
(45) Date of Patent: Dec. 1, 2015

(54) REVERSIBLE INFANT SUPPORTING APPARATUS

(71) Applicant: WONDERLAND NURSERYGOODS COMPANY LIMITED, Central Hong KOng (HK)

(72) Inventors: Andrew J. R. Horst, West Lawn, PA (US); Curtis M. Hartenstine, Birdsboro, PA (US); Ryan N. Miller, Lancaster, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 0 days.

(21) Appl. No.: 14/166,972

(22) Filed: Jan. 29, 2014

(65) Prior Publication Data

US 2014/0208503 A1 Jul. 31, 2014

Related U.S. Application Data

(60) Provisional application No. 61/849,566, filed on Jan. 29, 2013.

(51) Int. Cl.

| | |
|---|---|
| ***A47D 7/01*** | (2006.01) |
| ***A47D 7/04*** | (2006.01) |
| ***A47D 9/00*** | (2006.01) |

(52) U.S. Cl.

CPC .. *A47D 7/01* (2013.01); *A47D 7/04* (2013.01); *A47D 9/00* (2013.01)

(58) Field of Classification Search

CPC ..... A47D 7/00–7/04; A47D 9/00–9/02; A47D 13/02

USPC ..... 5/93.1, 93.2, 655; 256/25

See application file for complete search history.

(56) References Cited

U.S. PATENT DOCUMENTS

| | | | |
|---|---|---|---|
| 2012/0037870 | A1 | 2/2012 | Fiore, Jr. et al. |
| 2012/0204347 | A1 | 8/2012 | Li |
| 2013/0047335 | A1 | 2/2013 | Zeng et al. |

FOREIGN PATENT DOCUMENTS

| | | | |
|---|---|---|---|
| DE | 102011109874 | A1 | 3/2012 |

*Primary Examiner* — Peter M Cuomo
*Assistant Examiner* — Brittany Wilson
(74) *Attorney, Agent, or Firm* — David I. Roche; Baker & McKenzie LLP

(57) ABSTRACT

An infant supporting apparatus includes a leg frame, a support frame portion connected with the leg frame via a rotary joint, a reversible infant resting support suspended from the support frame portion and having a first and a second bearing surface, an offset frame portion, and a side panel connected with the support frame portion and the offset frame portion. The support frame portion can rotate relative to the leg frame to position the first or second bearing surface upward for placement of a child thereon. The infant resting support is adjustable relative to the side panel between a first and a second state. The first bearing surface faces upward and the side panel expands above the infant resting support in the first state, and the second bearing surface faces upward and the side panel is in a collapsed position relative to the infant resting support in the second state.

37 Claims, 16 Drawing Sheets

REVERSIBLE INFANT SUPPORTING APPARATUS

CROSS-REFERENCE TO RELATED APPLICATION

This application claims priority to U.S. Provisional Patent Application No. 61/849,566 filed on Jan. 29, 2013, which is incorporated herein by reference.

BACKGROUND

1. Field of the Invention

The present invention relates to infant supporting apparatuses that can be used in combination with a play yard.

2. Description of the Related Art

Portable play yards currently available on the market are usually sold with a variety of accessories such as a removable diaper changing station, napper station and bassinet. Unfortunately, these accessories are conventionally designed to be attached to the top rails of the play yard. Because the top rails offer a limited space for attachment, it may be difficult to use all of the accessories at the same time. For example, both the napper station and diaper changing station usually make it impossible to use the bassinet in the play yard. Moreover, the conventional design of the aforementioned accessories does not allow to use them independently as standalone devices.

Therefore, there is a need for infant supporting apparatuses that are more versatile in use, and can address at least the foregoing issues.

SUMMARY

The present application describes an infant supporting apparatus. The infant supporting apparatus includes a leg frame, a support frame portion, a reversible infant resting support, an offset frame portion vertically apart from the support frame portion, and a side panel. The support frame portion is connected with the leg frame via a rotary joint. The infant resting support is suspended from the support frame portion and has a first and a second bearing surface facing opposite directions, the support frame portion being operable to rotate relative to the leg frame to position either of the first and second bearing surface upward for placement of a child thereon. The side panel respectively connects with the support frame portion and the offset frame portion. The infant resting support is adjustable relative to the side panel between a first and a second state, the first bearing surface facing upward and the side panel expanding above the infant resting support in the first state, and the second bearing surface facing upward and the side panel being in a collapsed position relative to the infant resting support in the second state.

Advantages of the infant supporting apparatus includes the ability to provide a reversible infant resting support having two opposite bearing surfaces either of which that can be selectively turned upward for placement of a child thereon. Moreover, the infant supporting apparatus includes a side panel that may expand to increase the depth at which a first bearing surface of the infant resting support is suspended in a first configuration of use, and displaced to a collapsed position relative to the infant resting support to reduce the depth at which a second bearing surface of the infant resting support is suspended in a second configuration of use. Accordingly, the infant supporting apparatus can be used in a more versatile manner.

DETAILED DESCRIPTION OF THE EMBODIMENTS

Figure 1:
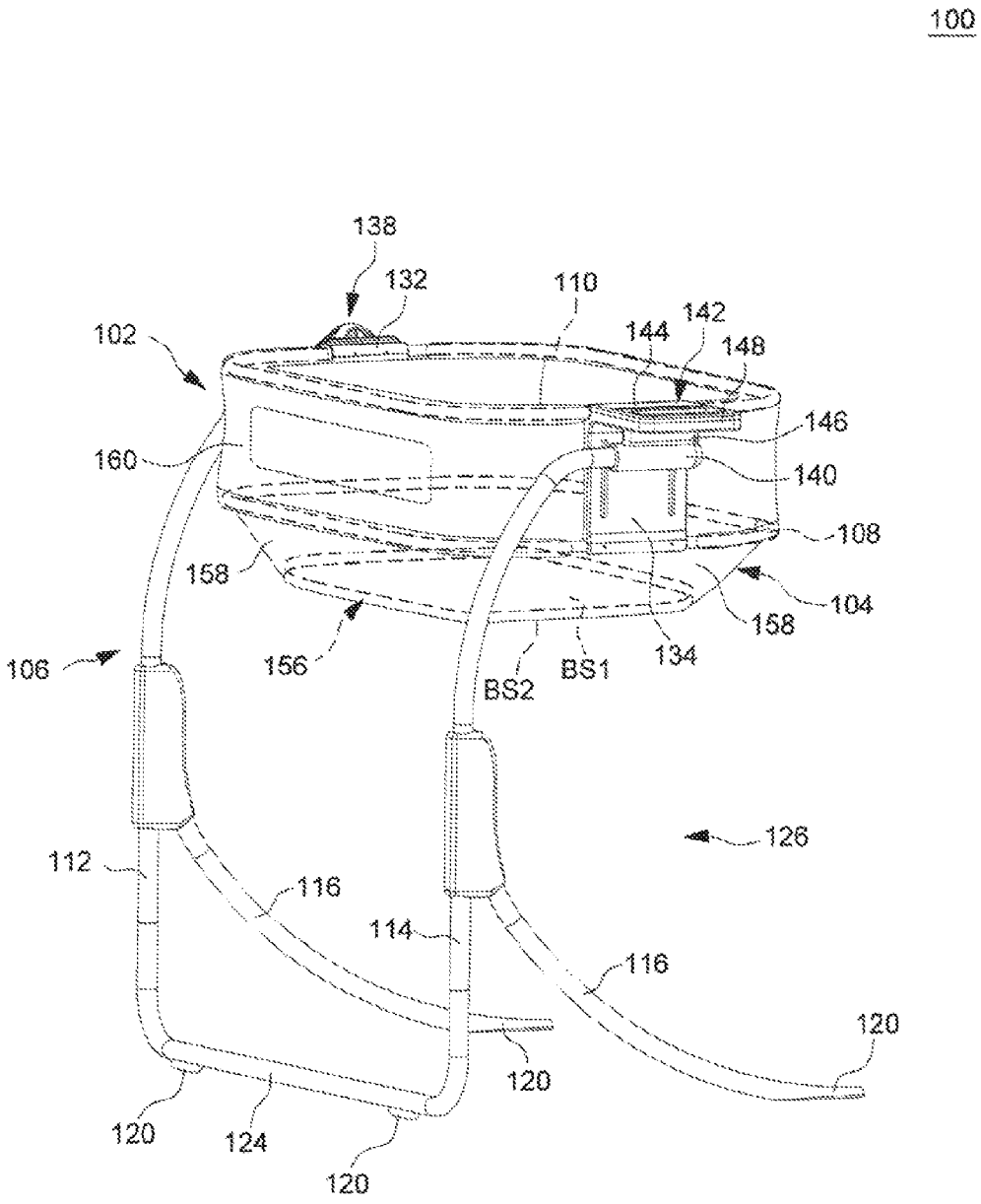
FIG. 1 is a perspective view illustrating one embodiment of an infant supporting apparatus.
Figure 2:
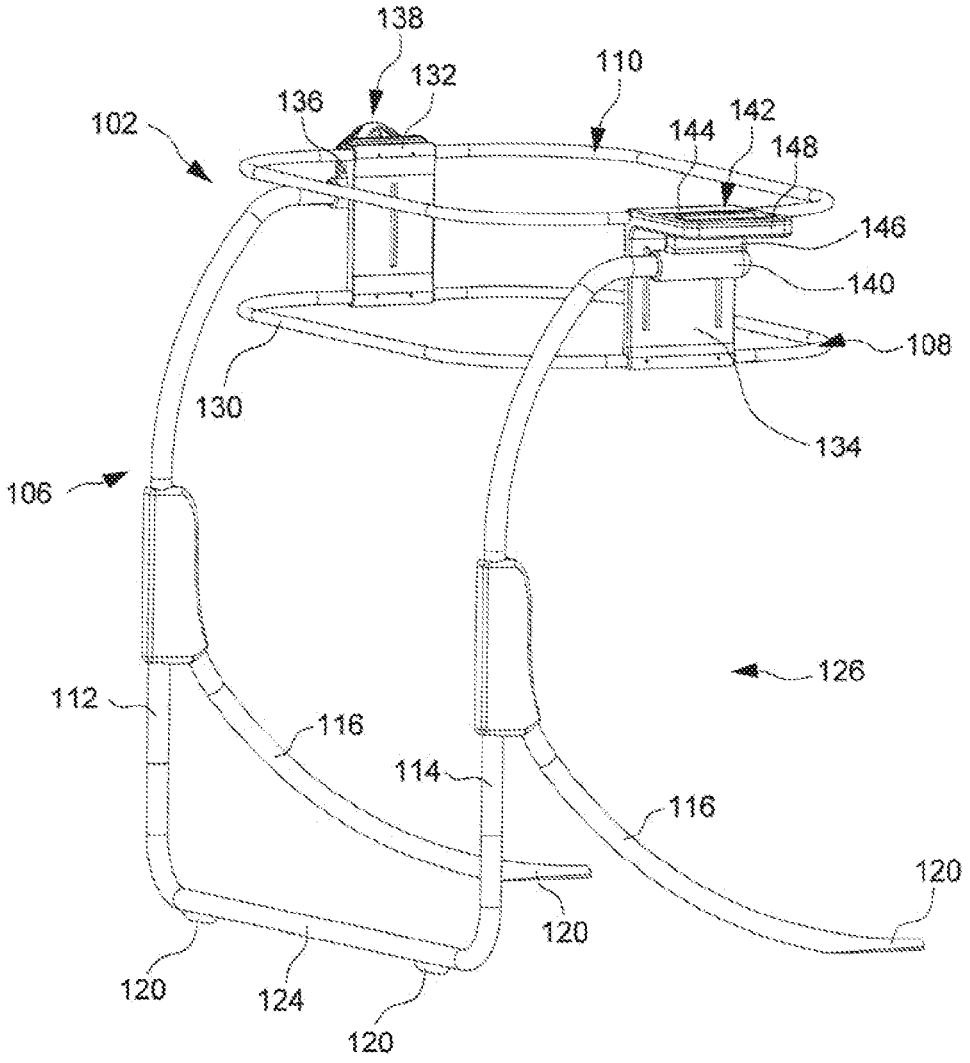
FIG. 2 is a schematic view illustrating a frame structure of the infant supporting apparatus shown in FIG. 1.
Figure 3:
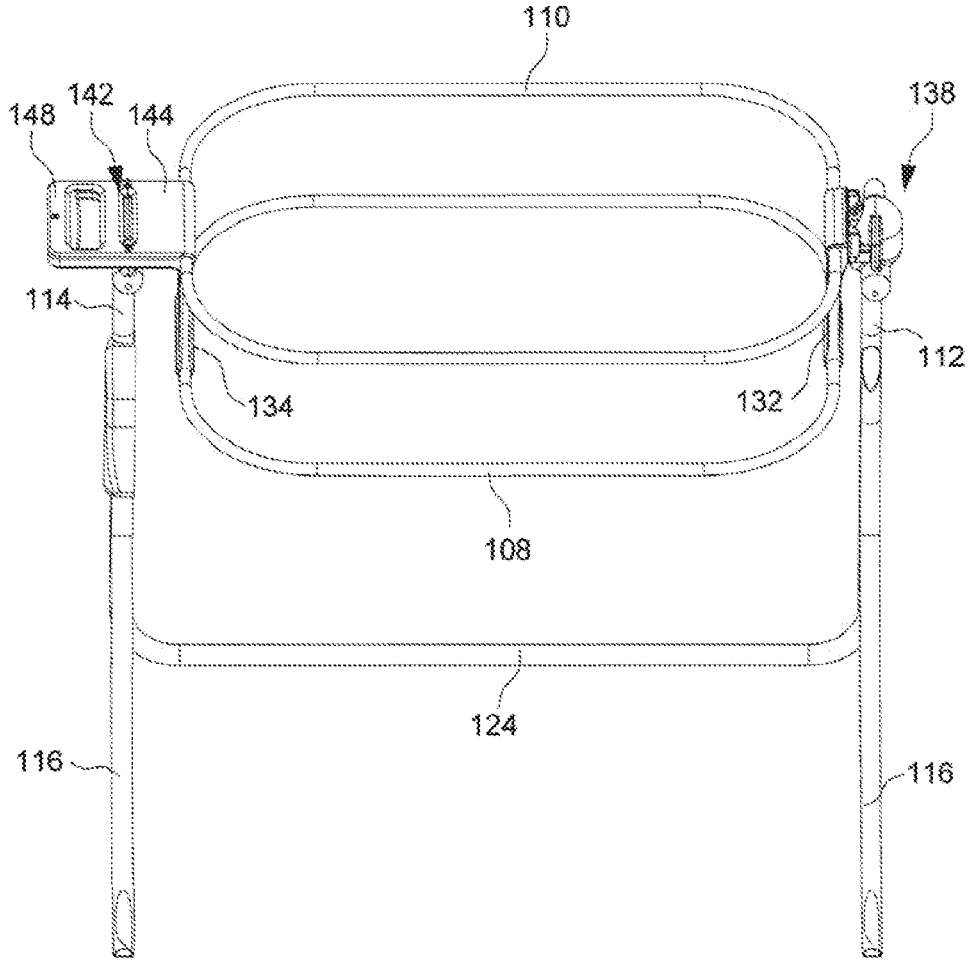
FIG. 3 is a schematic view illustrating the frame structure of FIG. 2 under another perspective.

FIG. 1 is a perspective view illustrating one embodiment of an infant supporting apparatus 100, and FIGS. 2 and 3 are schematic views illustrating a frame structure of the infant supporting apparatus 100. The infant supporting apparatus 100 can include a frame structure 102, and an infant resting support 104 coupled with the frame structure 102. The frame structure 102 can include a leg frame 106, a support frame portion 108 and an offset frame portion 110. The leg frame 106 can stand on a ground surface, and the infant resting support 104 can be suspended from the support frame 108 to receive the placement of a child thereon.

The leg frame 106 can include two spaced-apart legs 112 and 114, each of which can be formed by one or more tube segment. Each of the legs 112 and 114 can include a divergent structure 116. Lower portions of the legs 112 and 114 and the divergent structures 116 can form foot portions 120 that can rest against a ground surface. For improving stability, a cross bar 124 can extend between and connect with the legs 112 and 114 to provide rigidity to the leg frame 106. A clearance 126 can be defined between the two legs 112 and 114. The clearance 126 can vertically extend from the level of the foot portions 120 to the infant resting support 104.

Referring to FIG. 2, the support frame portion 108 can be formed by the assembly of one or more tube segments, and can be connected with the leg frame 106 at two upper end portions of the legs 112 and 114. For example, the support frame portion 108 can include a tubular structure 130 that has a closed shape and is affixed with two brackets 132 and 134 at two opposite sides. Each of the brackets 132 and 134 can have an elongated shape. The upper end portion of the leg 112 can be affixed with a coupling part 136, and the bracket 132 can be rotatably assembled with the coupling part 136 via a rotary joint 138. The upper end portion of the other leg 114 can be affixed with a coupling mount 140, and the bracket 134 can have a latching structure 142 that can detachably engage with the coupling mount 140. In one embodiment, the bracket 134 can have a L-shape including an arm 144, and the latching structure 142 can be provided at the arm 144. The latching structure 142 can exemplary include an opening through which a rib 146 protruding upward from the coupling mount 140 can engage to lock the bracket 134 with the coupling mount 140.

The rotary joint 138 can be a spherical joint that allows the support frame portion 108 (and the infant resting support 104 affixed therewith) to rotate spatially. In particular, the support frame portion 108 can be rotated about the spherical joint to cause the bracket 134 to move away from or toward the coupling mount 140, and to flip over the infant resting support 104. For facilitating the rotation of the support frame portion 108 about the rotary joint 138, the bracket 134 can be formed with a handle 148 that can be manually grasped by a caregiver to rotate the support frame portion 108 and the infant resting support 104 affixed therewith.

Referring again to FIGS. 1 and 2, the infant resting support 104 can be suspended from the support frame portion 108. The infant resting support 104 can include a fabric, cushion and like soft material for comfortable contact with a child. In some embodiments, the infant resting support 104 may also include a rigid or resilient board (not shown) to provide better support for the child. The infant resting support 104 can include a central portion 156, and lateral sidewall portions 158 disposed around the central portion 156. The sidewall portions 158 can be respectively connected with the central portion 156 and the support frame portion 108 (the lower ends of the sidewall portions 158 can be connected with the central portion 156 whereas the upper ends of the sidewall portions 158 can be connected with the support frame portion 108), so that the central portion 156 can be suspended from the support frame portion 108.

Figure 4:
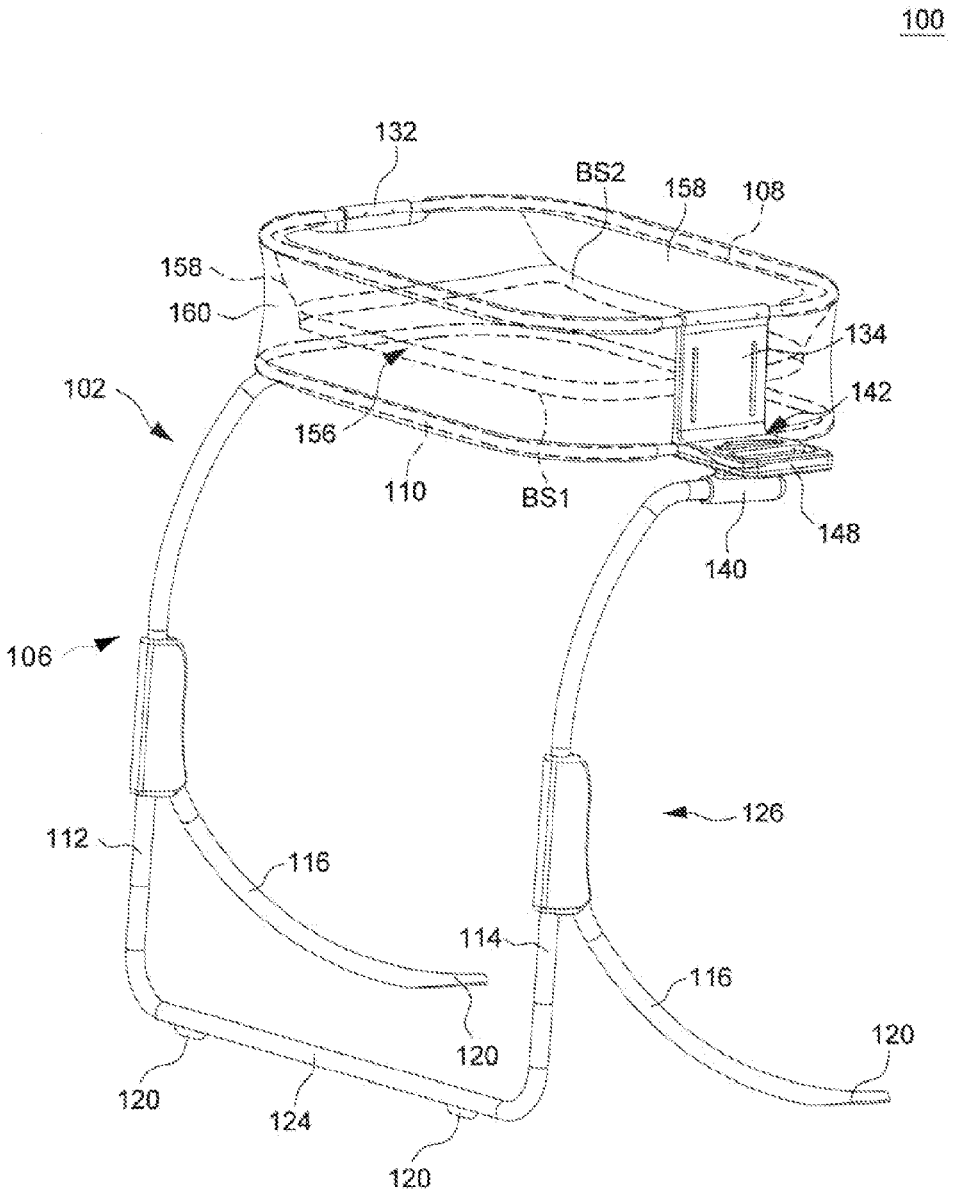
FIG. 4 is a schematic view illustrating the infant supporting apparatus of FIG. 2 in another configuration of use.

The central portion 156 can have two bearing surfaces BS1 and BS2 facing opposite directions. The support frame portion 108 and the infant resting support 104 are operable to rotate relative to the leg frame 106 to reversely turn either of the first and second bearing surface BS1 and BS2 upward for placement of a child thereon. For example, when the bearing surface BS1 is turned upward and the bearing surface BS2 turned downward, the infant resting support 104 can be configured as a bassinet (as shown in FIG. 1). In the bassinet configuration, a child can rest on the bearing surface BS1. In contrast, when the bearing surface BS2 is turned upward and the bearing surface BS1 turned downward, the infant resting support 104 can be configured as a changing station (as shown in FIG. 4). In the configuration of the changing station, the bearing surface BS2 can offer a flat bearing surface on which the child can be placed to facilitate diaper change.

Referring again to FIGS. 1 and 2, the offset frame portion 110 can be formed by the assembly of one or more tube segments, and can be affixed with the two brackets 132 and 134 vertically spaced apart from the support frame portion 108. For example, the offset frame portion 110 can include a tubular structure that has a closed shape and is affixed with the two brackets 132 and 134 at two opposite sides. In one embodiment, both the support frame portion 108 and the offset frame portion 110 can extend substantially parallel at two levels vertically spaced apart from each other. Moreover, the level of the offset frame portion 110 can be vertically offset from the rotary joint 138, whereas the level of the support frame portion 108 is adjacent to the rotary joint 138.

A side panel 160 can be connected with the support frame portion 108 and the offset frame portion 110. The side panel 160 can be made of flexible materials, which can include, a fabric, a screen mesh material, and the like. The side panel 160 can stretch vertically between the support frame portion 108 and the offset frame portion 110 so as to form an upright sidewall that surrounds an interior space of the infant supporting apparatus 100 in which a child can be received.

Depending on the needs, the infant supporting apparatus 100 can be configured as a bassinet or as a changing station, and the infant resting support 104 can be adjustable relative to the side panel 160 between a first state where the side panel 160 is in a deployed position relative to the infant resting support 104, and a second state where the side panel 160 is in a collapsed position relative to the infant resting support 104.

In FIG. 1, the infant supporting apparatus 100 is shown in the bassinet configuration. In this first state, the bearing surface BS1 faces upward, and the infant resting support 104 expands downward from a lower edge of the side panel 160. In particular, the offset frame portion 110 is located above the support frame portion 108, and the side panel 160 can stretch above the infant resting support 104 between the support frame portion 108 and the offset frame portion 110. Owing to the expanded side panel 160, the bearing surface BS1 facing upward can be suspended at a greater depth relative to a top rim defined by the offset frame portion 110 (i.e., corresponding to the top rim of the side panel 160). The height of the side panel 160 is such that it can form an effective surrounding enclosure preventing falling of the child placed on the bearing surface BS1.

Figure 5:
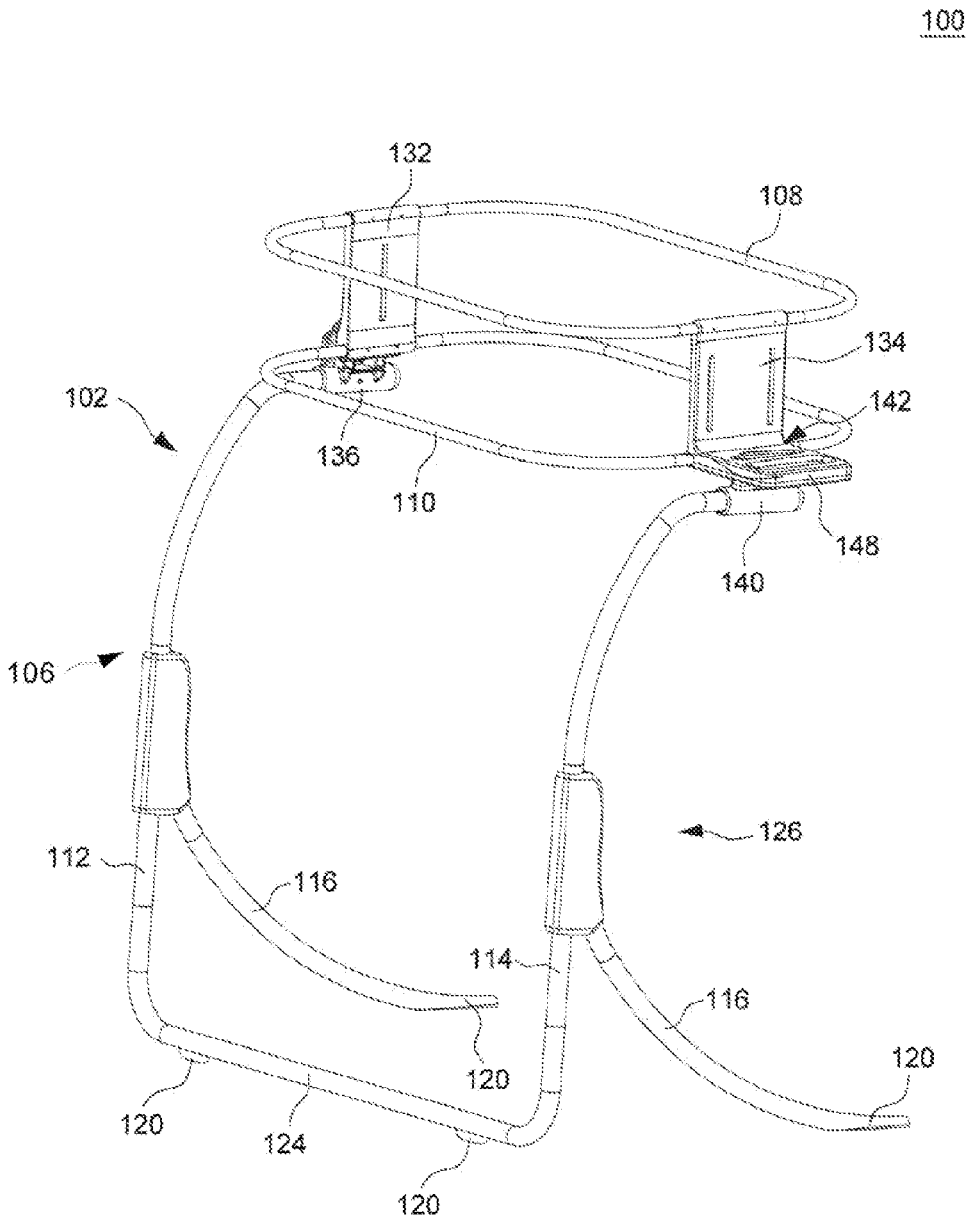
FIG. 5 is a schematic view illustrating the frame structure of the infant supporting apparatus in the configuration of use shown in FIG. 4.

Referring to FIGS. 4 and 5, for switching the infant supporting apparatus 100 from the bassinet configuration to the configuration of the changing station, the latching structure 142 can be unlocked, and the handle 148 can be grasped and lifted away from the coupling mount 140. Then the support frame portion 108 and the infant resting support 104 can be flipped over about the rotary joint 138 to turn the bearing surface BS2 upward and the bearing surface BS1 downward. In this second state, the support frame portion 108 is located above the offset frame portion 110, and the infant resting support 104 can fall toward an interior defined by the side panel 160. It is worth noting that the support frame portion 108 and the offset frame portion 110 are spaced apart from each other by a same fixed distance in both the first and second state, and the height of the stretched side panel 160 remains unchanged. In the second state, the infant resting support 104 (including the sidewall portions 158 and the central portion 156) can fall through an inner region surrounded by the side panel 160, and the sidewall portions 158 can extend through the inner region surrounded by the side panel 160. The side panel 160 is thereby in a collapsed position relative to the infant resting support 104, and the bearing surface BS2 facing upward is suspended at a depth relative to a top rim defined by the support frame portion 108 (i.e., corresponding to the top rim of the side panel 160) that is smaller than the depth at which the bearing surface BS1 is suspended in the bassinet configuration relative to the top rim defined by the offset frame portion 110. Accordingly, access to the bearing surface BS2 can be facilitated for changing the child's diaper.

Figure 6:
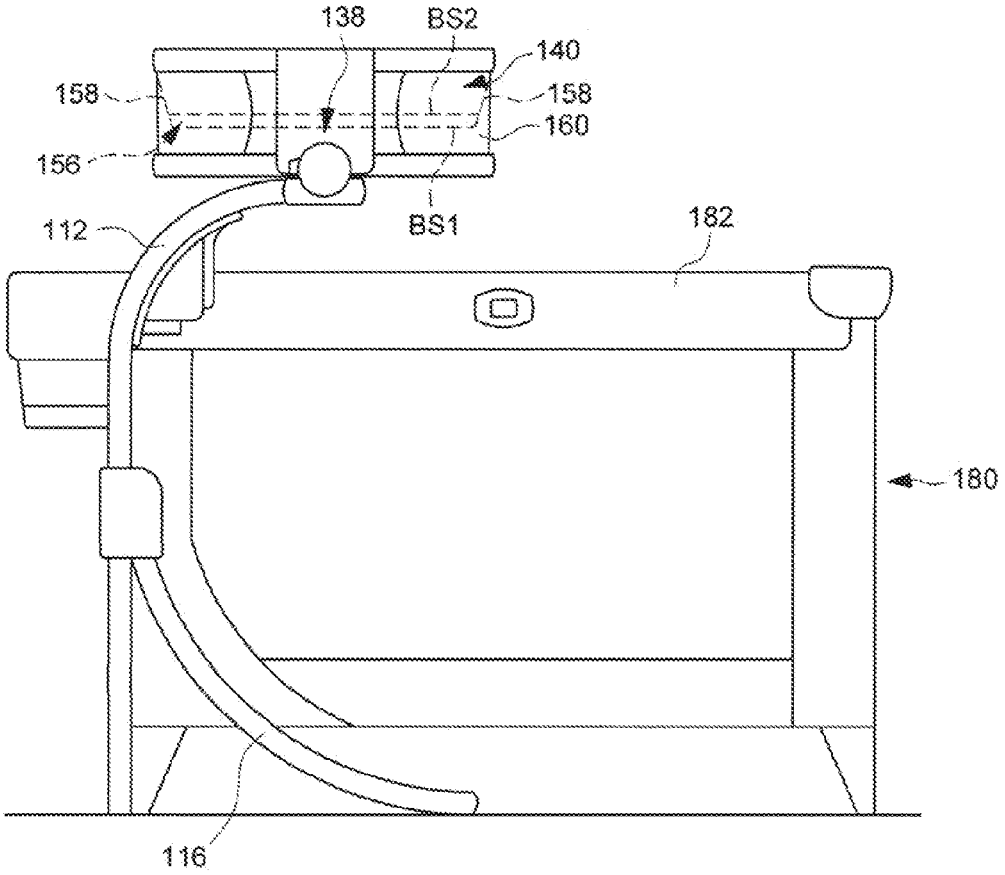
FIG. 6 is a schematic view illustrating the infant supporting apparatus of FIG. 1 used in combination with a play yard.

The infant supporting apparatus 100 can be used as a standalone device or in combination with a play yard. In conjunction with FIG. 5, FIG. 6 is a schematic view illustrating the infant supporting apparatus 100 used in combination with a play yard 180. The leg frame 106 of the infant supporting apparatus 100 can stand on a ground surface, and the play yard 180 can be nested through the clearance 126 between the legs 112 and 114 such that the infant resting support 104 can be suspended and span across the interior of the play yard 180 between two opposite upper rails 182 thereof.

Figure 7:
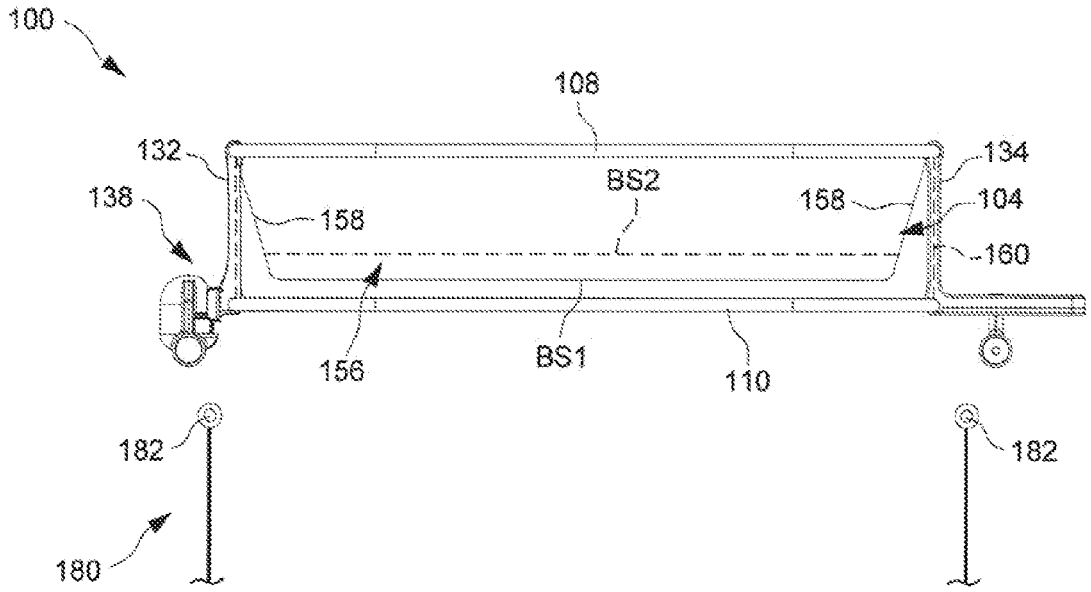
FIG. 7 is a schematic view illustrating a portion of the infant supporting apparatus shown in FIG. 1 used in combination with the play yard in the configuration of a changing station.
Figure 8:
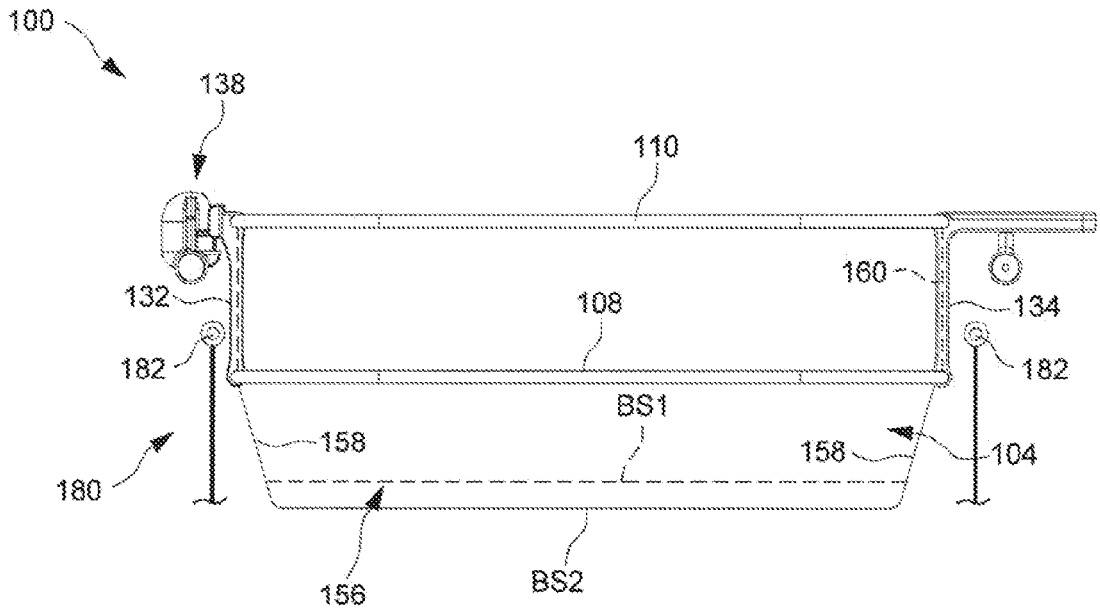
FIG. 8 is a schematic view illustrating a portion of the infant supporting apparatus shown in FIG. 1 used in combination with the play yard in a bassinet configuration.

FIG. 7 is a schematic view illustrating a portion of the infant supporting apparatus 100 used in combination with the play yard 180 in the configuration of the changing station, and FIG. 8 is a schematic view illustrating a portion of the infant supporting apparatus 100 used in combination with the play yard 180 in the bassinet configuration. Because the rotary joint 138 is offset from a central plane equidistant to the support frame portion 108 and the offset frame portion 110, the top rim defined by the support frame portion 108 in the configuration of the changing station can be higher than the top rim defined by the offset frame portion 110 in the bassinet configuration. When the infant supporting apparatus 100 is used in combination with the play yard 180 in the configuration of the changing station as shown in FIG. 7, the bearing surface BS2 facing upward thus can be held substantially above the upper rails 182 of the play yard 180, which can greatly facilitate access to the infant resting support 104. Conversely, when the infant supporting apparatus 100 is used in combination with the play yard 180 in the bassinet configuration as shown in FIG. 8, the bearing surface BS1 facing upward can be further lowered below the upper rails 182, which can offer a safer environment for sleeping a child.

Figure 9:
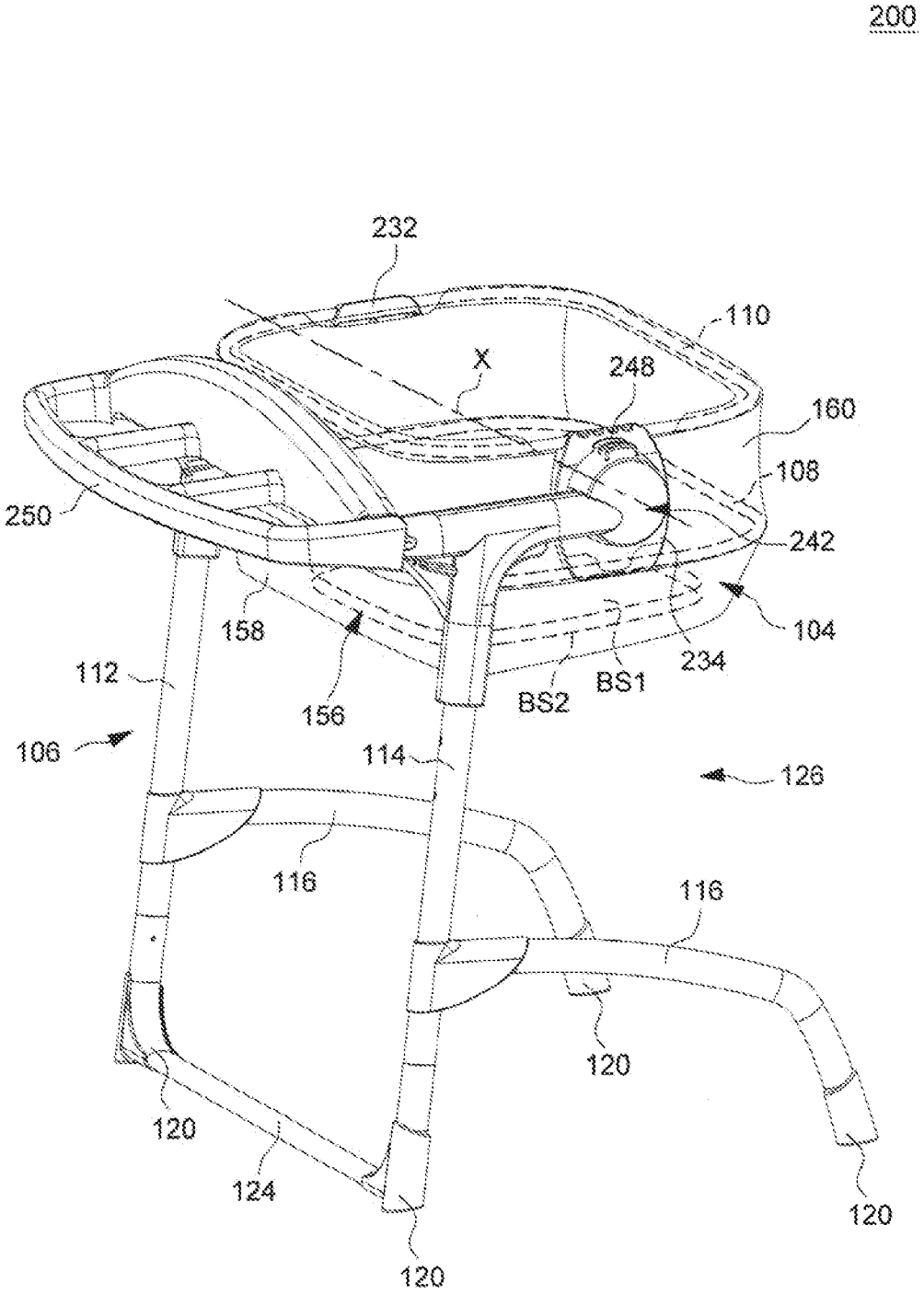
FIG. 9 is a schematic view illustrating another embodiment of an infant supporting apparatus.
Figure 10:
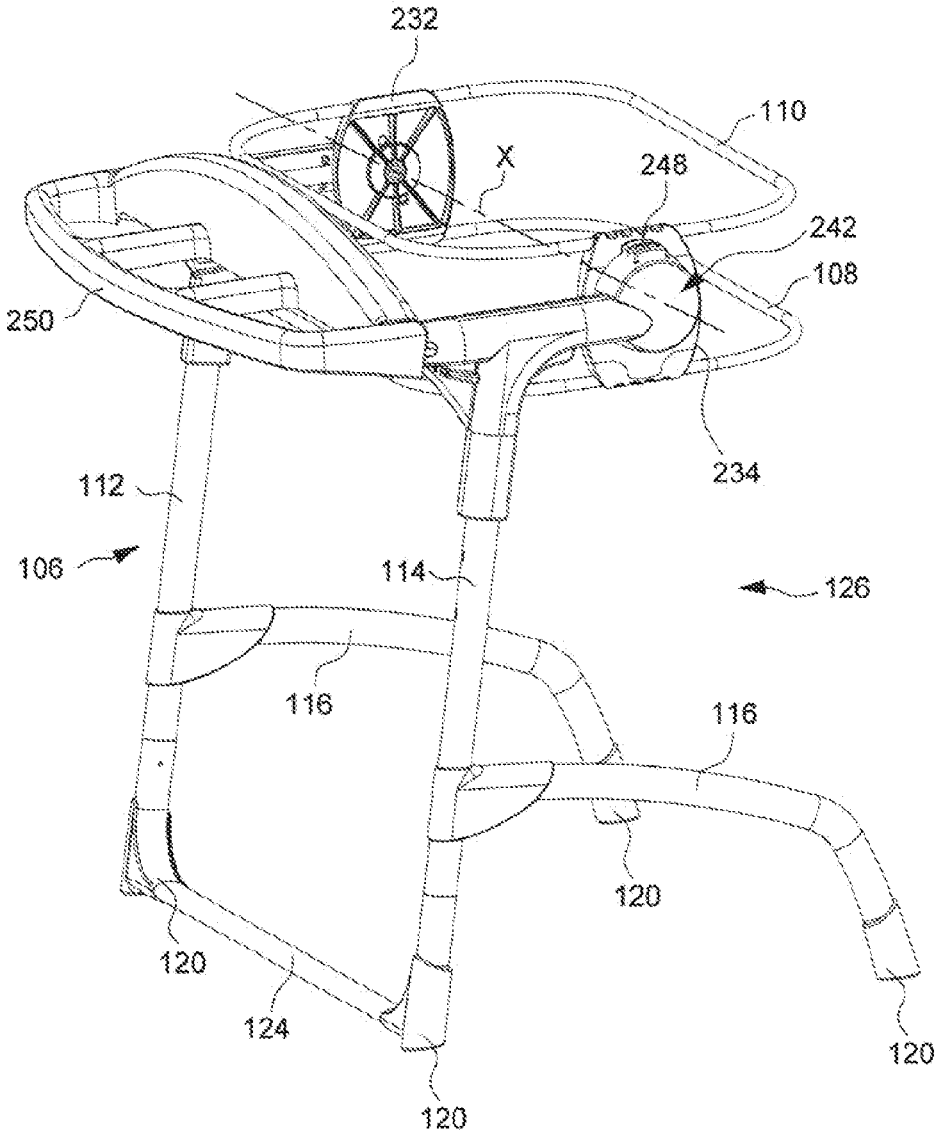
FIG. 10 is a schematic view illustrating a frame structure of the infant supporting apparatus shown in FIG. 9.
Figure 11:
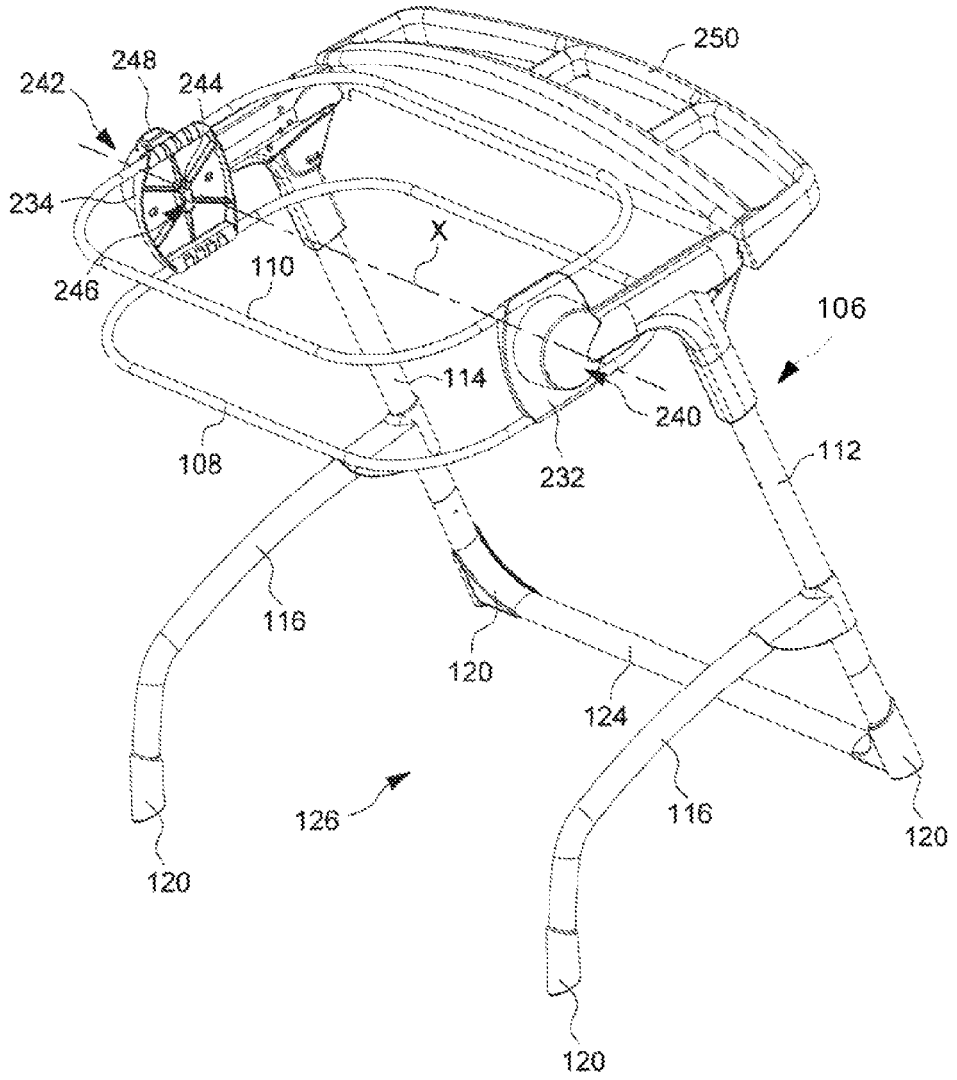
FIG. 11 is a schematic view illustrating the frame structure of FIG. 10 under another perspective.

FIGS. 9-11 are schematic views illustrating a variant embodiment of an infant supporting apparatus 200. Like previously described, the infant supporting apparatus 200 can include the leg frame 106 having the clearance 126, the support frame portion 108 and the offset frame portion 110 respectively affixed with two brackets 232 and 234 at two levels vertically spaced apart, the infant resting support 104 suspended from the support frame portion 108, and the side panel 160 connected with the support frame portion 108 and the offset frame portion 110. In the infant supporting apparatus 200, however, the two brackets 232 and 234 are pivotally assembled with the leg frame 106 via two rotary joints 240 and 242 that define a pivot axis X about which the support frame portion 108, the offset frame portion 110 and the infant resting support 104 can rotate relative to the leg frame 106. The pivot axis X can be substantially centered on the central plane that is equidistant from the respective levels of the support frame portion 108 and the offset frame portion 110. The support frame portion 108, the offset frame portion 110 and the infant resting support 104 can rotate about the pivot axis X to turn the bearing surface BS1 upward and the bearing surface BS2 downward for configuring the infant supporting apparatus 200 as a bassinet, or to turn the bearing surface BS2 upward and the bearing surface BS1 downward for configuring the infant supporting apparatus 200 as a changing station.

One or two of the two rotary joints 240 and 242 may include a latching mechanism operable to lock the support frame portion 108 in the bassinet configuration and the configuration of the changing station. For example, referring to FIG. 11, the rotary joint 242 can include a shaft 244 that is assembled through an elongated slot 246 formed in the bracket 234, and a release actuator 248 that is operatively connected with an inner latch (not shown) capable of engaging with the bracket 234 so as to prevent its rotation about the pivot axis X. The shaft 244 can be centered on the pivot axis X, and the elongated slot 246 may extend vertically so that the bracket 234 can move vertically relative to the shaft 244.

When the support frame portion 108, the offset frame portion 110 and the infant resting support 104 are locked in either of the bassinet configuration and the configuration of the changing station, the shaft 244 can be located near an upper end of the elongated slot 246, and the inner latch (not shown) of the rotary joint 242 can engage with the bracket 234 to prevent rotation of the support frame portion 108, the offset frame portion 110 and the infant resting support 104 relative to the leg frame 106. To switch from the bassinet configuration to the configuration of the changing station (or reversely), the release actuator 248 can be pressed down to unlock the inner latch, and the bracket 234 can be lifted up and then rotated to turn either of the bearing surfaces BS2 and BS1 upward. Once the desired configuration is reached, the bracket 234 can be pressed down, and the inner latch can engage with the bracket 234 for locking the support frame portion 108, the offset frame portion 110 and the infant resting support 104 in place.

Referring again to FIG. 9, the infant supporting apparatus 200 can further an organizer tray 250 fixedly assembled with the leg frame 106 adjacent to the infant resting support 104.

When the infant supporting apparatus 200 is used in combination with a play yard 180 as shown in FIG. 6, the leg frame 106 of the infant supporting apparatus 200 can stand on a ground surface, and the play yard can be nested through the clearance 126 between the legs 112 and 114 such that the infant resting support 104 can span across the interior of the play yard between the two opposite upper rails 182 thereof.

Figure 12:
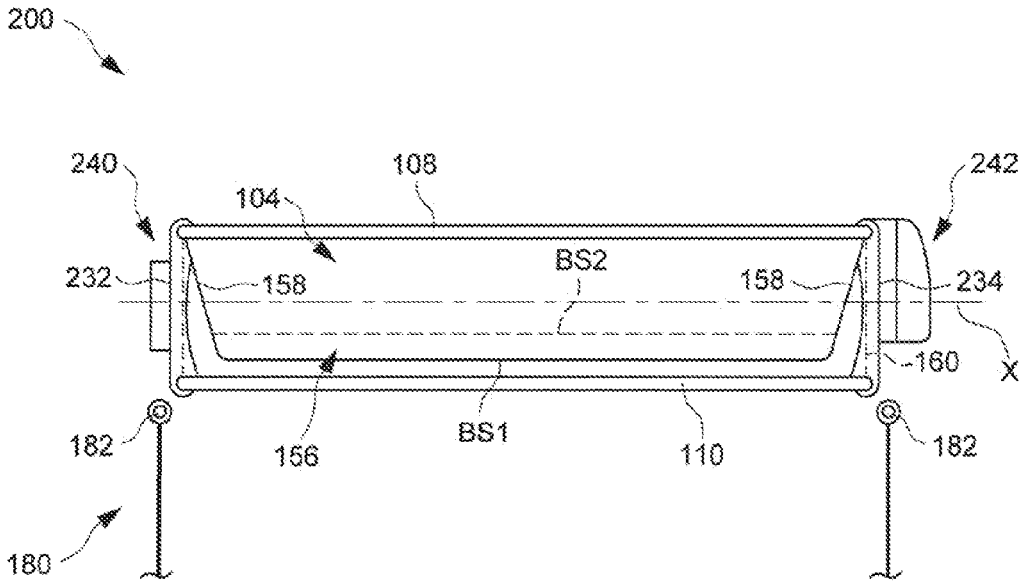
FIG. 12 is a schematic view illustrating a portion of the infant supporting apparatus of FIG. 9 used in combination with a play yard in the configuration of the changing station.
Figure 13:
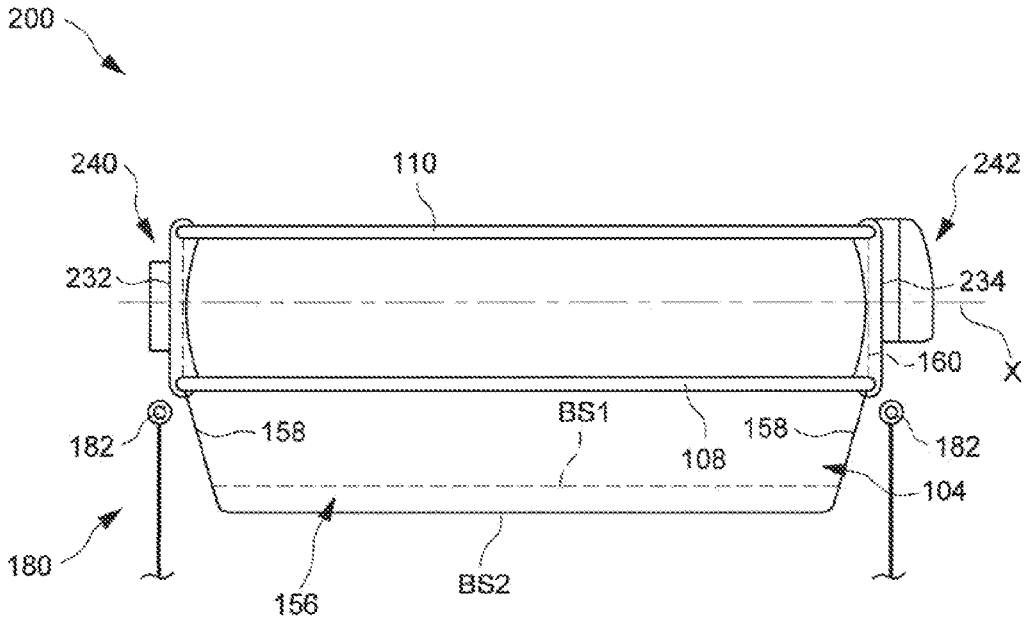
FIG. 13 is a schematic view illustrating a portion of the infant supporting apparatus of FIG. 9 used in combination with a play yard in the bassinet configuration.

In conjunction with FIGS. 9-11, FIG. 12 is a schematic view illustrating a portion of the infant supporting apparatus 200 used in combination with the play yard 180 in the configuration of the changing station, and FIG. 13 is a schematic view illustrating a portion of the infant supporting apparatus 200 used in combination with the play yard 180 in the bassinet configuration. Because the rotary joints 240 and 242 and the pivot axis X are substantially centered on the central plane equidistant to the support frame portion 108 and the offset frame portion 110, the top rim defined by the support frame portion 108 in the configuration of the changing station can be at the same height as the top rim defined by the offset frame portion 110 in the bassinet configuration.

In the configuration of the changing station as shown in FIG. 12, the bearing surface BS2 turns upward and the bearing surface BS1 turns downward. Moreover, the support frame portion 108 is located above the offset frame portion 110, the side panel 160 is in a collapsed position relative to the infant resting support 104, and the sidewall portions 158 of the infant resting support 104 extend through an inner region surrounded by the side panel 160. The bearing surface BS2 facing upward can be suspended above the upper rails 182 of the play yard at a relatively swallow depth relative to a top rim defined by the support frame portion 108.

In the bassinet configuration shown in FIG. 13, the bearing surface BS1 faces upward, the offset frame portion 110 is located above the support frame portion 108, and the side panel 160 can be in the expanded state stretching above the infant resting support 104 between the support frame portion 108 and the offset frame portion 110. Moreover, the bearing surface BS1 facing upward can be suspended below the upper rails 182 of the play yard at a depth relative to a top rim defined by the offset frame portion 110 that is greater than the depth at which the bearing surface BS2 is suspended in the configuration of the changing station.

Figure 14:
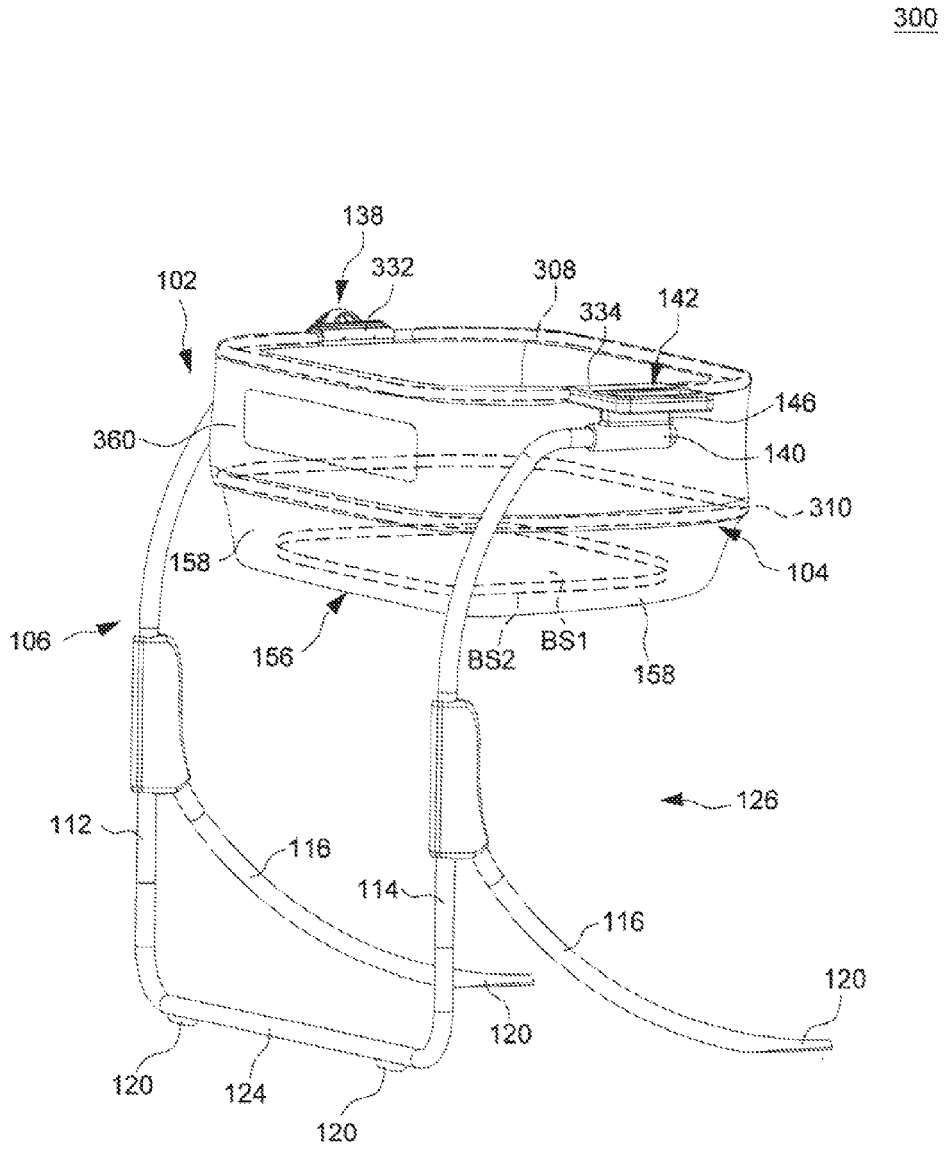
FIG. 14 is a schematic view illustrating yet another embodiment of an infant supporting apparatus.
Figure 15:
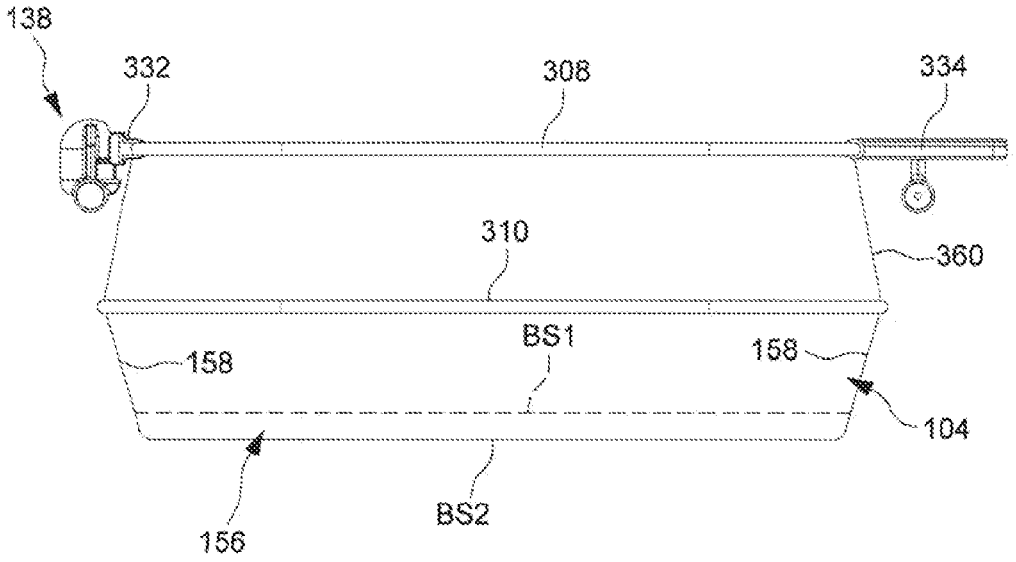
FIG. 15 is a schematic view illustrating a portion of the infant supporting apparatus shown in FIG. 14 in the bassinet configuration.
Figure 16:
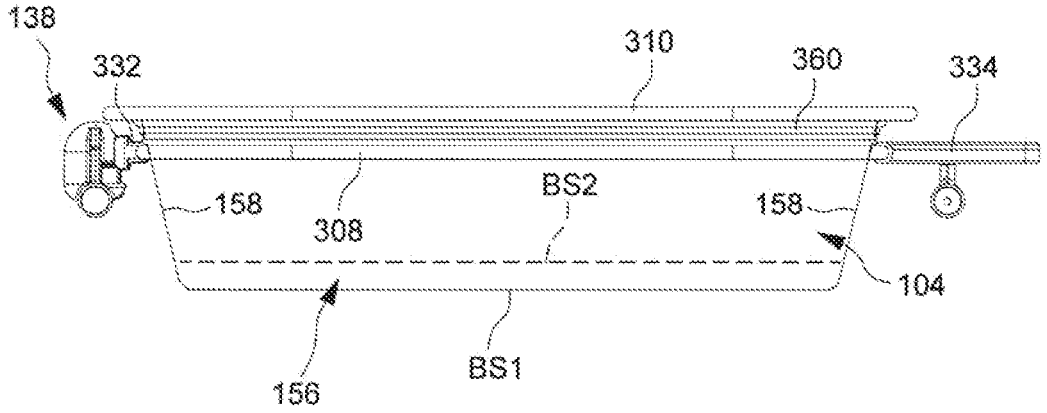
FIG. 16 is a schematic view illustrating a portion of the infant supporting apparatus shown in FIG. 14 in the configuration of a changing station.

FIGS. 14-16 are schematic views illustrating another embodiment of an infant supporting apparatus 300. Like previously described, the infant supporting apparatus 300 can include the leg frame 106 having the clearance 126, a support frame portion 308 respectively affixed with two brackets 332 and 334, and the infant resting support 104 suspended from the support frame portion 308. The bracket 332 can be rotatably assembled with the leg 112 via the rotary joint 138, which may be a spherical joint or a pivot joint as described previously. The bracket 334 can have the latching structure 142 that can detachably engage with the coupling mount 140 affixed with the other leg 114.

One difference of the infant supporting apparatus 300 lies in the assembly of the offset frame portion 310 and the side panel 360. Referring to FIG. 15, the side panel 360 can be respectively connected with the support frame portion 308 and the infant resting support 104. The side panel 360 can be made of flexible materials, which can include, a fabric, a screen mesh material, and the like. Moreover, the offset frame portion 310 can be assembled with the side panel 360 in a floating manner vertically apart from the support frame portion 308, and is movable vertically relative to the support frame portion 308. For example, the side panel 360 may form a loop in which is received the offset frame portion 310. The offset frame portion 310 may have a closed shape formed by the assembly of one or more tube segments, and may have a size that is larger than the size of the support frame portion 308 so that the offset frame portion 310 is prevented from traveling vertically past the support frame portion 308. In addition, the sidewall portions 158 of the infant resting support 104 can be respectively connected with the offset frame portion 310 and the central portion 156 carrying the two bearing surfaces BS1 and BS2 (the lower ends of the sidewall portions 158 can be connected with the central portion 156 whereas the upper ends of the sidewall portions 158 can be connected with the offset frame portion 310).

In FIG. 15, the bassinet configuration is shown with the bearing surface BS1 turned upward and the bearing surface BS2 turned downward. In the bassinet configuration, the infant resting support 104 is suspended from the support frame portion 308 by the side panel 360 which is in an expanded state, and the offset frame portion 310 is suspended by the side panel 360 at a position vertically displaced away from the support frame portion 308. The offset frame portion 310 is located vertically between the support frame portion 308 and the bearing surface BS1 of the infant resting support 104. Since the side panel 360 expands away from and stretches above the infant resting support 104, the bearing surface BS1 facing upward can be suspended at a greater depth relative to a top rim defined by the support frame portion 308. The height of the side panel 360 is such that it can form an effective surrounding enclosure preventing falling of the child placed on the bearing surface BS1.

For switching the infant supporting apparatus 300 between the bassinet configuration and the changing station, the support frame portion 308 can be rotated about the rotary joint 138 to flip over the infant resting support 104. In FIG. 16, the configuration of the changing station is shown with the bearing surface BS2 turned upward and the bearing surface BS1 turned downward. In this second state, the support frame portion 308 is located vertically between the offset frame portion 310 and the second bearing surface BS2, and the offset frame portion 310 is displaced toward the support frame portion 308 by gravity (e.g., the offset frame portion 310 can lie adjacently above the support frame portion 108) so as to collapse the side panel 360 toward the infant resting support 104. While the side panel 360 is in the collapsed position relative to the infant resting support 104, the sidewall portions 158 of the infant resting support 104 can extend through an inner region surrounded by the side panel 360. Owing to the collapsed position of the side panel 360, the bearing surface BS2 facing upward can be suspended at a depth relative to a top rim defined by the offset frame portion 310 that is smaller than the depth at which the bearing surface BS1 is suspended in the bassinet configuration.

Advantages of the structures described herein include the ability to provide infant supporting apparatuses that can be used independently as standalone devices or in combination with a play yard. The infant supporting apparatus includes a leg frame having a clearance through which a play yard can nest for saving space.

Moreover, the infant supporting apparatus can include a reversible infant resting support having two opposite bearing surfaces that is suspended from a support frame portion, an offset frame portion vertically spaced apart from the support frame portion, and a side panel connected with the support frame portion and the offset frame portion. The side panel may expand above the infant resting support to increase the depth at which a first bearing surface of the infant resting support is suspended in a first configuration of use, and displaced to a collapsed position relative to the infant resting support to reduce the depth at which a second bearing surface of the infant resting support is suspended in a second configuration of use. Accordingly, the infant supporting apparatus can be used in a more versatile manner.

Realizations of the infant supporting apparatuses have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant supporting apparatus comprising:

a leg frame;

a support frame portion connected with the leg frame via a rotary joint;

a reversible infant resting support suspended from the support frame portion and having a first and a second bearing surface facing opposite directions, wherein the support frame portion and the infant resting support are operable to rotate relative to the leg frame to position either of the first and second bearing surface upward for placement of a child thereon;

an offset frame portion placed vertically apart from the support frame portion; and a side panel respectively connecting with the support frame portion and the offset frame portion, wherein the infant resting support is adjustable relative to the side panel between a first and a second state, the first bearing surface facing upward and the side panel expanding above the infant resting support in the first state, and the second bearing surface facing upward and the side panel being in a collapsed position relative to the infant resting support in the second state.

2. The infant supporting apparatus according to claim 1, wherein the first bearing surface when facing upward is suspended at a first depth, and the second bearing surface when facing upward is suspended at a second depth, the first depth being greater than the second depth.

3. The infant supporting apparatus according to claim 2, wherein the side panel stretches above the infant resting support between the support frame portion and the offset frame portion in the first state.

4. The infant supporting apparatus according to claim 1, wherein the offset frame portion and the support frame portion are spaced apart from each other by a same fixed distance in the first and second state.

5. The infant supporting apparatus according to claim 1, wherein the infant resting support includes a central portion carrying the first and second bearing surfaces, and a plurality of sidewall portions respectively connected with the central portion, the sidewall portions extending through an inner region surrounded by the side panel in the second state.

6. The infant supporting apparatus according to claim 5, wherein the sidewall portions are further connected with the support frame portion.

7. The infant supporting apparatus according to claim 5, wherein the sidewall portions are further connected with the offset frame portion.

8. The infant supporting apparatus according to claim 1, wherein the offset frame portion is displaced away from the support frame portion in the first state, and the offset frame portion is displaced toward the support frame portion in the second state.

9. The infant supporting apparatus according to claim 1, wherein one of the offset frame portion and the support frame portion is vertically offset from the rotary joint.

10. The infant supporting apparatus according to claim 1, wherein the support frame portion and the offset frame portion respectively extend at two levels vertically spaced apart from each other, and the rotary joint is centered on a central plane equidistant to the two levels of the support frame portion and the offset frame portion.

11. The infant supporting apparatus according to claim 1, wherein the support frame portion and the offset frame portion are respectively affixed with a bracket that is assembled with the leg frame via the rotary joint.

12. The infant supporting apparatus according to claim 1, wherein the support frame portion and the offset frame portion are respectively affixed with a first and a second bracket at two opposite sides, the rotary joint being a spherical joint through which the first bracket is assembled with the leg frame, and the second bracket being operable to detach from and attach to the leg frame.

13. The infant supporting apparatus according to claim 1, wherein the offset frame portion is located vertically between the support frame portion and the first bearing surface in the first state, and the support frame portion is located vertically between the offset frame portion and the second bearing surface in the second state.

14. The infant supporting apparatus according to claim 13, wherein the offset frame portion is suspended from the support frame portion by the side panel in the second state.

15. The infant supporting apparatus according to claim 1, wherein the leg frame defines a clearance above which the infant resting support is suspended from the support frame portion, the clearance being sized to receive the placement of a play yard.

16. The infant supporting apparatus according to claim 1, further including an organizer tray supported by the leg frame side-by-side relative to the infant resting support.

17. The infant supporting apparatus according to claim 1, wherein the infant resting support is configured as a bassinet when the first bearing surface is positioned upward, and the infant resting support is configured as a changing station when the second bearing surface is positioned upward.

18. An infant supporting apparatus comprising:

a leg frame;

a support frame portion connected with the leg frame via a rotary joint;

a reversible infant resting support suspended from the support frame portion and having a first and a second bearing surface facing opposite directions, wherein the support frame portion and the infant resting support are operable to rotate relative to the leg frame to turn either of the first and second bearing surface upward for placement of a child thereon;

an offset frame portion placed vertically apart from the support frame portion; and a side panel respectively connected with the support frame portion and the offset frame portion, wherein the infant resting support is adjustable relative to the side panel between a first and a second state, the first bearing surface facing upward and the side panel expanding above the infant resting support in the first state, and the second bearing surface facing upward and the side panel being in a collapsed position surrounding the infant resting support in the second state.

19. The infant supporting apparatus according to claim 18, wherein the first bearing surface when facing upward is suspended at a first depth, and the second bearing surface when facing upward is suspended at a second depth, the first depth being greater than the second depth.

20. The infant supporting apparatus according to claim 19, wherein the side panel when in the expanded state stretches above the infant resting support.

21. The infant supporting apparatus according to claim 18, wherein the infant resting support includes a central portion carrying the first and second bearing surfaces, and a plurality of sidewall portions respectively connected with the central portion and the support frame portion, the sidewall portions falling through an inner region surrounded by the side panel in the second state.

22. The infant supporting apparatus according to claim 18, wherein the offset frame portion and the support frame portion are spaced apart from each other by a same distance when the side panel is in the first and second state.

23. The infant supporting apparatus according to claim 18, wherein one of the offset frame portion and the support frame portion is vertically offset from the rotary joint.

24. The infant supporting apparatus according to claim 18, wherein the support frame portion and the offset frame portion respectively extend at two levels vertically spaced apart from each other, and the rotary joint is substantially centered on a central plane equidistant to the two levels of the support frame portion and the offset frame portion.

25. The infant supporting apparatus according to claim 18, wherein the support frame portion and the offset frame portion are respectively affixed with a bracket that is assembled with the leg frame via the rotary joint.

26. The infant supporting apparatus according to claim 18, wherein the support frame portion and the offset frame portion are respectively affixed with a first and a second bracket at two opposite sides, the rotary joint being a spherical joint through which the first bracket is assembled with the leg frame, and the second bracket being operable to detach from and attach to the leg frame.

27. The infant supporting apparatus according to claim 18, wherein the leg frame defines a clearance above which the infant resting support is suspended from the support frame portion, the clearance being sized to receive the placement of a play yard.

28. The infant supporting apparatus according to claim 18, wherein the infant resting support is configured as a bassinet when the first bearing surface is positioned upward, and the infant resting support is configured as a changing station when the second bearing surface is positioned upward.

29. An infant supporting apparatus comprising:

a leg frame;

a support frame portion connected with the leg frame via a rotary joint;

a reversible infant resting support suspended from the support frame portion and having a first and a second bearing surface facing opposite directions, wherein the support frame portion and the infant resting support are operable to rotate relative to the leg frame to position either of the first and second bearing surface upward for placement of a child thereon;

an offset frame portion vertically movable relative to the support frame portion; and a side panel respectively connected with the support frame portion and the offset frame portion;

wherein the infant resting support is adjustable relative to the side panel between a first and a second state, the first bearing surface facing upward and the offset frame portion being displaced away from the support frame portion in the first state, and the second bearing surface facing upward and the offset frame portion being displaced toward the support frame portion in the second state.

30. The infant supporting apparatus according to claim 29, wherein the first bearing surface when facing upward is suspended at a first depth, and the second bearing surface when facing upward is suspended at a second depth, the first depth being greater than the second depth.

31. The infant supporting apparatus according to claim 30, wherein the side panel stretches above the infant resting support in the first state.

32. The infant supporting apparatus according to claim 29, wherein the infant resting support includes a central portion carrying the first and second bearing surfaces, and a plurality of sidewall portions respectively connected with the central portion and the offset frame portion, the side panel expanding above the infant resting support in the first state, and the side panel being collapsed and the sidewall portions extending through an inner region surrounded by the side panel in the second state.

33. The infant supporting apparatus according to claim 29, wherein the offset frame portion is located vertically between the support frame portion and the first bearing surface in the first state, and the support frame portion is located vertically between the offset frame portion and the second bearing surface in the second state.

34. The infant supporting apparatus according to claim 33, wherein the offset frame portion is suspended from the support frame portion by the side panel in the first state.

35. The infant supporting apparatus according to claim 29, wherein the leg frame defines a clearance above which the infant resting support is suspended from the support frame portion, the clearance being sized to receive the placement of a play yard.

36. The infant supporting apparatus according to claim 29, wherein the infant resting support is configured as a bassinet when the first bearing surface is positioned upward, and the infant resting support is configured as a changing station when the second bearing surface is positioned upward.

37. The infant supporting apparatus according to claim 1, wherein the resting support, the support frame and the offset frame are rotatable together for turning the first or second bearing surface upward.

* * * * *